US010017945B2

(12) United States Patent
Fuoco

(10) Patent No.: US 10,017,945 B2
(45) Date of Patent: Jul. 10, 2018

(54) DOWNSPOUT CLEANING DEVICE

(71) Applicant: James Fuoco, Des Plaines, IL (US)

(72) Inventor: James Fuoco, Des Plaines, IL (US)

( * ) Notice: Subject to any disclaimer, the term of this patent is extended or adjusted under 35 U.S.C. 154(b) by 155 days.

(21) Appl. No.: 14/713,728

(22) Filed: May 15, 2015

(65) Prior Publication Data

US 2016/0333590 A1 Nov. 17, 2016

(51) Int. Cl.

| | |
|---|---|
| ***E04D 13/076*** | (2006.01) |
| ***B08B 9/04*** | (2006.01) |
| ***B08B 9/043*** | (2006.01) |
| *E04D 13/08* | (2006.01) |

(52) U.S. Cl.

CPC ..... *E04D 13/0765* (2013.01); *B08B 9/04* (2013.01); *B08B 9/0436* (2013.01); *E04D 2013/0866* (2013.01)

(58) Field of Classification Search

CPC ..... B08B 9/027; B08B 9/04; B08B 9/043; B08B 9/045; B08B 9/0436; E04D 13/0765; E03C 1/302; E03F 9/002; E03F 9/005

USPC ..... 15/104.05, 104.16, 104.31, 104.33, 15/236.04

See application file for complete search history.

(56) References Cited

U.S. PATENT DOCUMENTS

| | | | | |
|---|---|---|---|---|
| 195,181 A * | 9/1877 | Strohm | F41A 29/02 | 15/104.16 |
| 566,110 A * | 8/1896 | Wrigley | E03F 9/005 | 15/104.33 |
| 1,910,768 A * | 5/1933 | Hotchkiss, Jr. | E03C 1/302 | 144/104 |
| 4,006,508 A * | 2/1977 | Brown | B60S 5/00 | 15/104.05 |
| 4,756,043 A * | 7/1988 | Hazelet | E04D 13/0765 | 15/104.05 |

FOREIGN PATENT DOCUMENTS

GB 2098301 * 11/1982

* cited by examiner

*Primary Examiner* — Mark Spisich
(74) *Attorney, Agent, or Firm* — Marshall, Gerstein & Borun LLP

(57) ABSTRACT

An apparatus for removing debris, including an elongated hollow structure wherein, at least a portion of the elongated hollow structure extends in a curved configuration. The elongated hollow structure comprises a sidewall which defines an opening which extends within and along the elongated structure. The sidewall also defines a first and second apertures spaced apart from one another and in communication with the opening. The apparatus further includes an elongated insert member having a length which exceeds a length of the elongated hollow structure and has a width dimension smaller than a width dimension of the opening and the first and second apertures such that the elongated insert member slides within the elongated hollow structure and in and out of the first and second apertures.

13 Claims, 4 Drawing Sheets

DOWNSPOUT CLEANING DEVICE

FIELD

The present invention relates to device for cleaning a downspout of a building, and more particularly, to clean the downspout with a user of the device positioned below an opening of the downspout, which is positioned within a gutter.

BACKGROUND

Cleaning clogged downspouts of a building or home is often a treacherous and difficult task. The one who is to do the cleaning typically must climb a ladder to be positioned above a gutter of the building or must climb a ladder and be positioned on the roof of the building so as to access the downspout opening positioned within the gutter. In addition, on occasions the cleaner may need to carry or haul a pressurized hose up to the gutter or roof level so as to position the nozzle of the hose to access the downspout opening in the gutter, which adds to the difficulty of the task.

In the instance where the a pressurized hose is used, the cleaner aims the pressurized hose at the opening in a downward direction at the downspout. Should the water pressure be sufficient, the debris can then be dislodged and pushed down the downspout and out of a bottom opening positioned in the downspout. This can be particularly difficult if the debris is trapped or solidified in a portion of the downspout which extends under the eaves of the building.

In other circumstances, the cleaner may use the handle portion of a rake or broom to attempt to dislodge the debris in the downspout by pushing the handle into the opening of the downspout. This approach is also difficult, particularly if the debris is located in the downspout which extends under an eave of the building. The handles are typically stiff and will not bend to accommodate the curved contour of the downspout that extends under the eaves.

SUMMARY

An example of an apparatus for removing debris includes an elongated hollow structure wherein at least a portion of the elongated hollow structure extends in a curved configuration. The elongated hollow structure includes a sidewall which defines an opening which extends within and along the elongated structure and defines a first and second apertures spaced apart from one another and in communication with the opening. The apparatus further includes an elongated insert member having a length which exceeds a length of the elongated hollow structure and has a width dimension smaller than a width dimension of the opening and the first and second apertures such that the elongated insert member slides within the elongated hollow structure and in and out of the first and second apertures.

An example of a method for removing debris, includes the steps of positioning at least a portion of, of at least a portion of an elongated hollow structure which extends in a curved configuration to extend over a gutter of a building. The elongated hollow structure includes a sidewall which defines an opening which extends within and along the elongated hollow structure. The sidewall defines a first aperture and a second aperture spaced apart from one another and in communication with the opening. The method further includes grasping a rod positioned extending out of the first aperture wherein an end of the rod is connected to a ram component within the elongated hollow structure A width dimension of each of the rod and the ram component is smaller than a dimension of the opening and of each of the first and second apertures and the length of the rod and ram component is longer than the elongated hollow structure. The method further includes moving a portion of the rod into the elongated hollow structure through the first aperture and into the elongated hollow structure thereby moving at least a portion of the ram component through and away from the second aperture.

Figure 1:
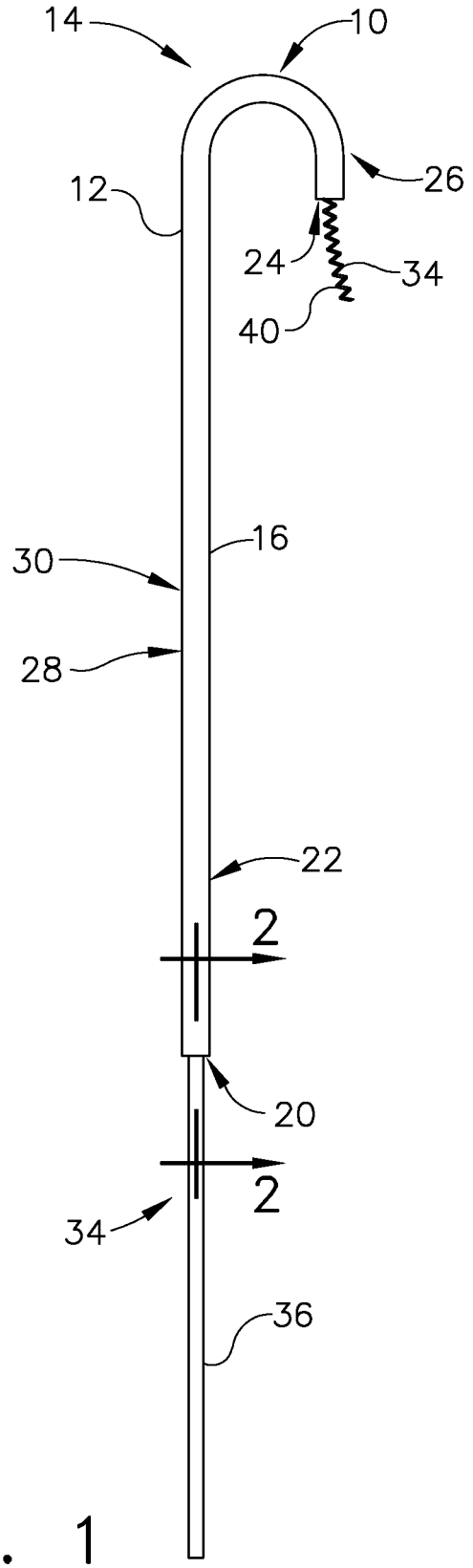
FIG. 1 is a front elevation view of the apparatus for removing debris.

Before any independent features and embodiments of the invention are explained in detail, it is to be understood that the invention is not limited in its application to the details of the construction and the arrangement of the components set forth in the following description or illustrated in the drawings. The invention is capable of other embodiments and of being practiced or of being carried out in various ways. Also, it is understood that the phraseology and terminology used herein is for the purpose of description and should not be regarded as limiting.

DESCRIPTION

Figure 6:
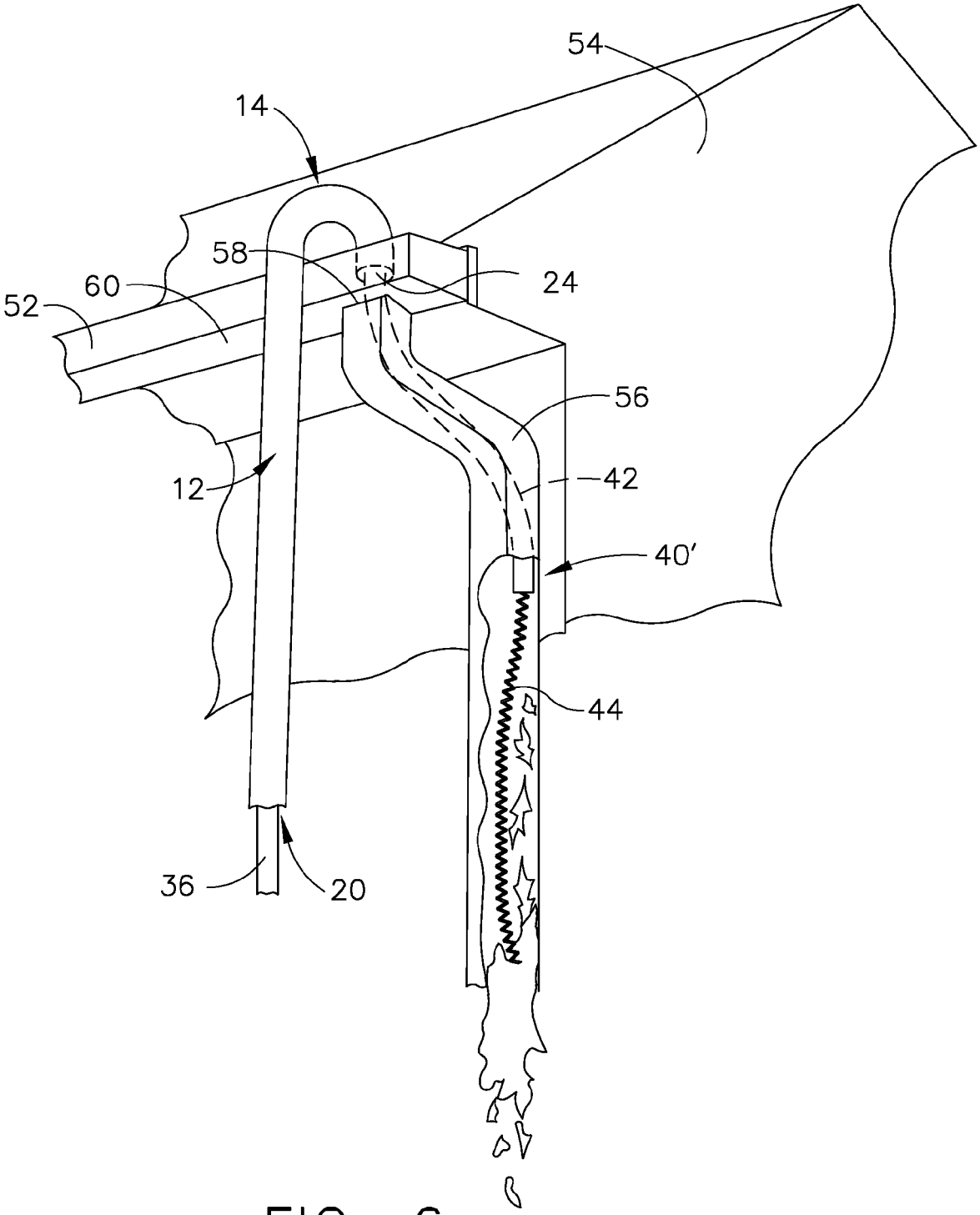
FIG. 6 is a perspective partial broken away view of the apparatus in operation for removing debris, which was lodged within a downspout.

In referring to FIG. 1, an apparatus for removing debris 10 is shown. Apparatus 10 includes elongated hollow structure or housing 12. At least a portion 14 of elongated hollow structure 12 extends in a curved configuration. In this embodiment, the curved configuration is a portion of the elongate hollow structure 12, wherein in other examples the curved configuration of the at least a portion 14 could include a substantial portion or the entire elongated hollow structure 12 being in a curved configuration. The curved configuration permits a user to be positioned below a gutter and have elongated hollow structure 12 extend into the gutter to align with a downspout opening, as seen in FIG. 6, which will be discussed in more detail below.

Figure 2:
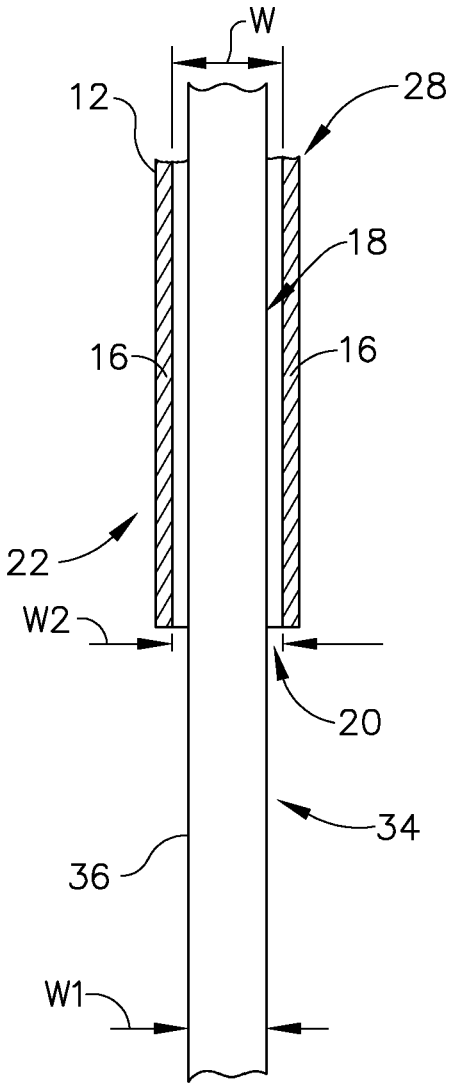
FIG. 2 is a partial broken away and enlarged cross section as seen along line 2-2 of FIG. 1.
Figure 3:
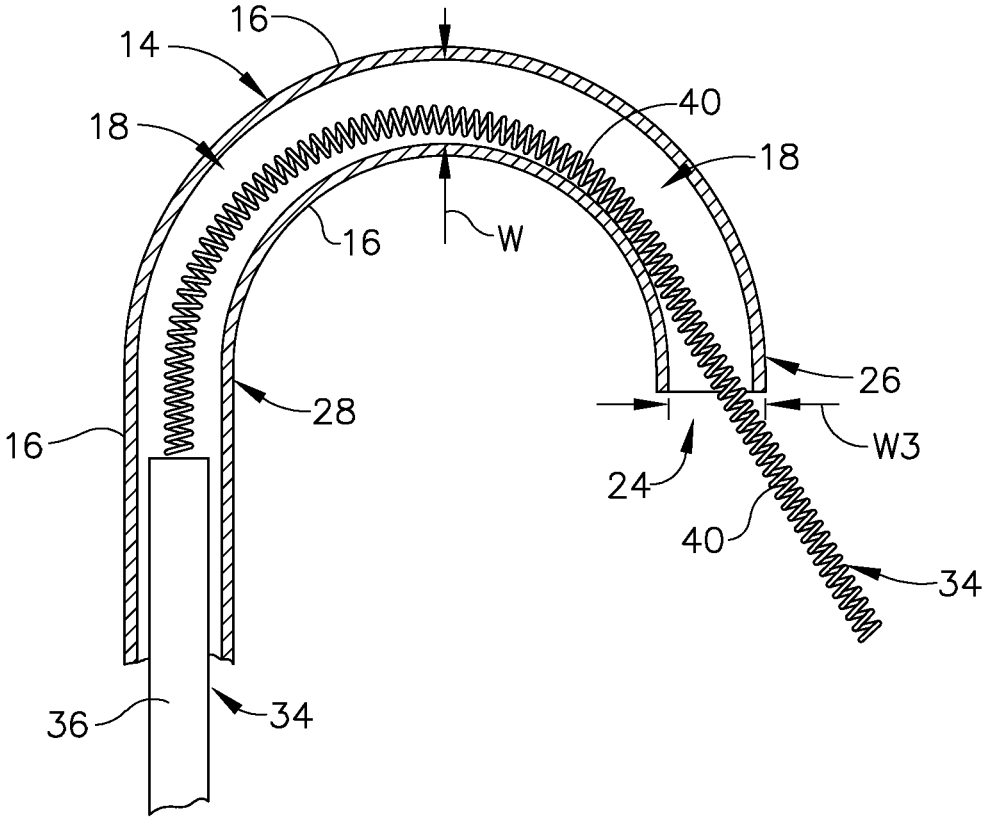
FIG. 3 is a is a partial broken away fragmentary up right sectional view of a curved portion of the apparatus shown in FIG. 1.

Elongated hollow structure 12 has a sidewall 16 which defines an opening 18, as seen in FIGS. 2 and 3, which extends within and along elongated hollow structure 12. Sidewall 16 further defines a first aperture 20 defined at a first end 22 of elongated hollow structure 12 in communication with opening 18 and second aperture 24 is defined at a second end 26 of elongated hollow structure 12, as seen in FIGS. 1-2. First and second apertures 20 and 24 are spaced apart from one another at opposite first and second ends 22 and 26, respectively, of elongated hollow structure 12.

In this example, elongated hollow structure 12 is formed from tube 28. Tube 28 forms and defines opening 18 having a width W, as a diameter, as seen in FIG. 2. Tube 28 is constructed from a selected material from a wide variety of materials such as plastic, steel or aluminum. The material should provide tube 28 sufficient integrity to allow the user to grip near first end 22 and be able to easily control the direction in which tube 28 is to extend so as to direct tube 28 to align with a downspout opening. In this example, a first portion 30 of elongated hollow structure 12, as seen in FIG. 1, extends linearly. The at least a portion or second portion 14, of elongate hollow structure 12, which is in a curved configuration, in this example, extends from first portion 30.

Further in this example, second portion 14 extends from first portion 30, in the curved configuration and extends through approximately one hundred and eighty degrees) (180°). This amount of curvature permits the user to more easily position second aperture 24 of elongated hollow structure 12 over a gutter downspout opening, which will be discussed in more detail below. First aperture 20 is positioned at first end 22 of first portion 30 and second aperture 24 is positioned at second end 26 of second portion 14 positioning first and second apertures 20 and 24 at opposite ends of elongated hollow structure 12, which will provide openings from which elongate insert member 34, as seen in FIGS. 4 and 5, to travel in and out of during operation of apparatus 10, as will be described in more detail below and seen in FIG. 6.

Figure 4:
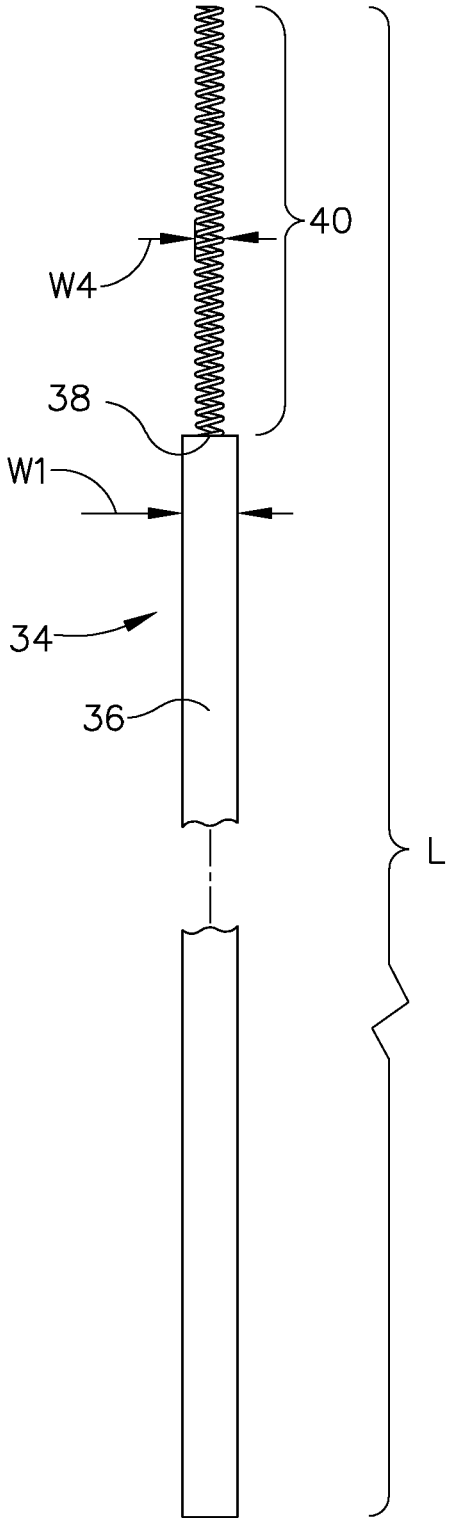
FIG. 4 is a front elevation view of an elongate insert member with a first embodiment of a ram component.
Figure 5:
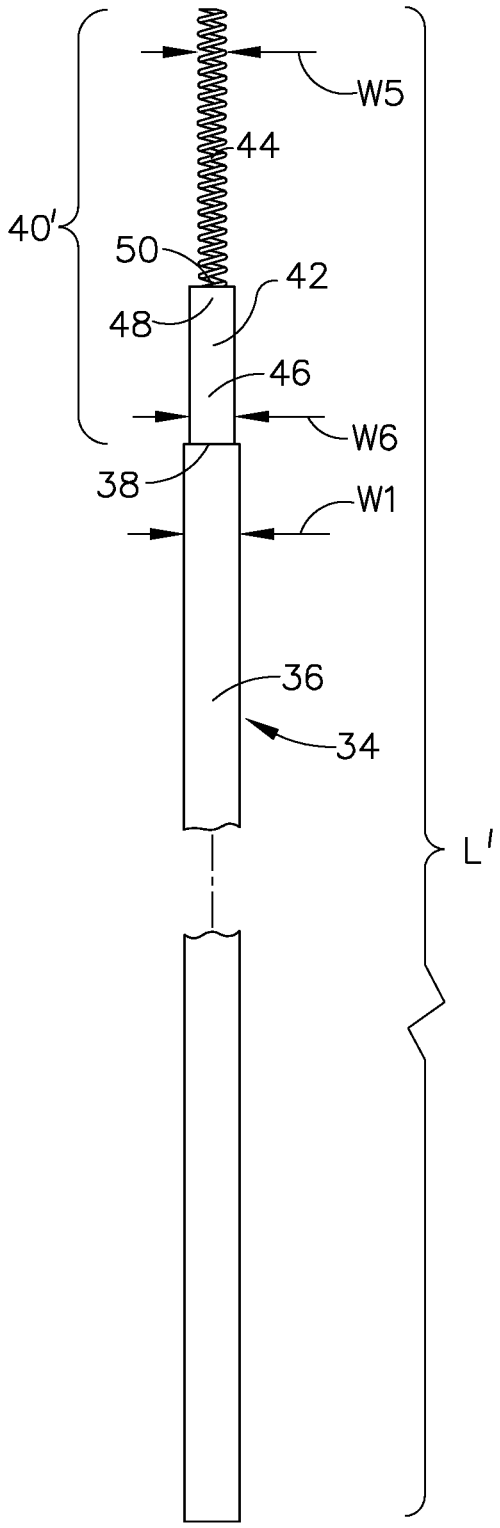
FIG. 5 is a front elevation view of an elongate insert member with a second embodiment of a ram component.

Elongated insert member 34 is positioned within elongate hollow structure 12, as seen in FIG. 2, and has a smaller width dimension W1 than width dimension W of opening 18 and width dimension W2 of first aperture 20 and width dimension W3 of second aperture 24, as seen in FIGS. 2-5. With the width dimension W1 of elongated insert member 34 being smaller than the width dimensions of opening 18 and first and second apertures 20 and 24, elongated insert member 34 can move freely within and out of elongated hollow structure 12. Elongated insert member 34 has a length L, as seen in FIG. 4, which exceeds a length of the elongated hollow structure 12, as seen in FIG. 1. As will be appreciated in the operation of apparatus 10 below, elongate insert member 34 will be moved by the user to exit second aperture 24 of elongate hollow structure 12 to impact debris that creates blockage within in a downspout extending from a gutter.

Elongate insert member 34 can be constructed in a number of ways, such that it is permitted to freely move into and out of elongate hollow structure 12. In the examples of elongate insert member 34 shown in FIGS. 4 and 5, rod 36 forms a portion of insert member 34 that extends out of first aperture 20 of elongate hollow structure 12, as seen in FIG. 1. Rod 36 can be constructed from a wide selection of materials such as plastic, steel, aluminum and fiberglass or the like. Rod 36 needs to have sufficient integrity to transmit the force applied by a hand of the user using a pushing force onto rod 36, and rod 36, in turn, transmits that force along to the remainder of elongate insert member 34, moving elongate insert member 34 outwardly from elongate hollow structure 12 from second aperture 24. Thus, if in other embodiments where some curved configuration is within a portion of elongate hollow structure 12 in which rod 36 travels, rod 36 will be constructed of a material such that rod 36 will sufficiently bend and transmit suitable force to a remainder of insert member 34.

In a first embodiment of elongate insert member 34, as seen in FIG. 4, elongate insert member 34 includes rod 36 which has end 38 connected to ram component 40. In this example, ram component 40 is unitarily constructed of the same material. Ram component 40 can be selected to be constructed from a wide variety of materials, such as, rubber, vinyl, polyurethane, spring metal and flexible conduit. The construction of ram component 40 can include at least a portion constructed of one of a hollow and solid structure. Ram component 40 could also be at least partially constructed of a metal spring. In the embodiment, ram component 40 is constructed of a metal spring.

Ram component 40 is constructed of a material more flexible than the material from which rod 36 is constructed. Rod 36 will be of a stiffer construction, in this embodiment, since, rod 36 will be transmitting force to ram component 40 and rod 36 will be configured lengthwise to travel within first portion 30 of elongated structure 12 which is substantially linear, which will not require rod 36 to bend. In contrast, ram component 40 will be constructed of a material that is more flexible, in this embodiment, than that of rod 36 and will be able to travel through second portion 14 having a curved configuration and not be hung up in traveling through the second portion 14. Thus, the composition of ram component 40 will provide the flexibility needed for ram component 40 to travel through a curved configuration of elongate hollow structure 12 but will also provide toughness for confronting and pushing debris located in a downspout.

In referring to FIG. 5, elongate insert member 34 is shown, wherein insert member 34 comprises rod 36 as was discussed above with respect to FIG. 4. Insert member 34 in FIG. 5, includes second embodiment of ram component 40'. Second embodiment for ram component 40' includes two different components, ram link 42 and ram 44. A first end 46 of ram link 42 is connected to end 38 of rod 36. A second end 48 of ram link 42 is connected to first end 50 of ram 44. In this example, both ram link 42 and ram 44 are constructed of material more flexible than rod 36. One or both of ram link 42 and ram 44 is constructed of one of rubber, vinyl, polyurethane, spring metal and flexible conduit. The construction of ram component 40' can include at least a portion constructed of one of a hollow and solid structure. Ram component 40' could also be at least partially constructed of a metal spring. In this second embodiment of ram component 40' ram link 42 is constructed of a rubber hollow construction and ram 44 is constructed of a metal spring. Again, rod 36 in this example, is not traveling within second portion 14 with the curved configuration, however, ram link 42 and ram 44 both travel through the second portion 14 with the curved configuration. As a result, more flexibility is needed for ram link 42 and ram 44 than is needed for rod 36.

In referring to FIG. 6, a method for removing debris is shown. The method includes the step of positioning at least a portion of, of at least a portion 14 of elongated hollow structure 12 having a curved configuration to extend over gutter 52 of building 54. The elongated hollow structure 12 comprises a sidewall 16, as described above, which defines opening 18 which extends within and along the elongated hollow structure 12, as can be seen in FIGS. 2 and 3. Sidewall 16 defines a first aperture 20 and a second aperture 24 spaced apart from one another and in communication with opening 18, as likewise seen in FIGS. 2 and 3.

Another step in this method includes grasping rod 36 positioned extending out of first aperture 20 and an end 38 of rod 36 is connected, in this embodiment, to a ram component 40' within the elongated hollow structure 12, as seen in FIGS. 5 and 6. A width dimension W1 and W6 and W5 of each of rod 36, and ram link 42 and ram 44 of ram component 40', respectively, is smaller than a width dimension W, W2 and W3 of the opening 18 and each of the first and second apertures 20 and 24, respectively. This is similarly true for width dimensions W4 of ram component 40 being smaller in dimension than opening 18 and first and second apertures 20 and 24, respectively. The lengths L of rod 36 and ram component 40, as shown in FIG. 4, and the length L' of rod 36 and ram component 40' In FIG. 5 are longer than the elongated hollow structure 12, as seen in FIG. 1.

The method also includes the step of moving a portion of rod 36 into the elongated hollow structure 12 through first aperture 20 and into the elongated hollow structure 12. Rod 36, as can be seen in FIG. 1, is in position where it has not yet been moved into elongated hollow structure 12 through aperture 20 and ram component 40 is only extending a short distance from second aperture 24 outside of elongated hollow structure 12. With moving a portion of rod 36 into elongated hollow structure 12, in referring to FIG. 6, ram component 40' extends from second aperture 24 clearing debris that was lodged in downspout 56. This action can be repeated with pulling back on rod 36 and retracting portions of ram component 40' back into elongated hollow structure 12 and then again moving a portion of rod 36 back into elongate hollow structure 12.

The method further includes the step of positioning second aperture 24 over an opening 58 of down spout 56 defined in bottom portion 60 of the gutter 52 wherein the elongated hollow structure 12 includes, in this example, a first portion 30 which extends substantially in a linear direction and the at least a portion 14 of the elongated hollow structure 12 which extends in the curved configuration. The step of moving rod 36 includes sliding rod 36 within first portion 30.

The step of sliding rod 36 within first portion 30 also includes sliding ram component 40', comprising a ram link 42 connected to a ram 44, within opening 18 of the elongated hollow structure 12. This step further includes the step of moving at least a portion of the ram 44 out of and away from second aperture 24 and into downspout 56. Ram component 40 is similarly employed in such fashion as ram component 40', wherein either embodiment is moved to impact the debris.

As discussed above, the method can be repeated in order to break loose debris from within downspout 56. The method includes the step of pulling or retracting rod 36 away from the elongated hollow structure 12 to extract at least a portion of the rod 36 out of the elongated hollow structure 12 and moving ram component 40' into the elongated hollow structure 12 in a direction of and through the second aperture 24. With ram component 40' retracted, the user can then again move a portion of rod 36 back into the elongated hollow structure 12 causing ram component 40' again to move away from elongated hollow structure 12 to impact debris.

What is claimed:

1. An apparatus for removing debris, comprising:

an elongated hollow structure wherein:

at least a portion of the elongated hollow structure extends in a curved configuration; and the elongated hollow structure comprises a sidewall which defines an opening which extends within and along the elongated structure and defines a first and second apertures spaced apart from one another and in communication with the opening; and an elongated insert member having a length which exceeds a length of the elongated hollow structure and has a width dimension smaller than a width dimension of the opening and the first and second apertures such that the elongated insert member slides within the elongated hollow structure and in and out of the first and second apertures, wherein the elongated insert member comprises:

a rod; and a ram component comprising a ram link and a ram connected to an end of the rod, wherein:

the ram link extends from an end of the rod;

the ram extends from the end of the ram link and comprises one of a spring structure or flexible conduit;

each of the ram link and the ram are more flexible than the rod; and a width dimension of the ram link is less than a width dimension of the rod and a width dimension of the ram is less than the width dimension of the ram link.

2. The apparatus for removing debris of claim 1, wherein the elongated hollow structure comprises a tube and the width dimension of the opening comprises an interior diameter of the tube.

3. The apparatus for removing debris of claim 1, wherein the elongated hollow structure is constructed of one of plastic, steel or aluminum material.

4. The apparatus for removing debris of claim 1, wherein a first portion of the elongated hollow structure extends linearly and a second portion of the elongated hollow structure extends from the first portion in the curved configuration.

5. The apparatus for removing debris of claim 4, wherein the curved configuration extends through approximately one hundred and eighty degrees from the first portion.

6. The apparatus for removing debris of claim 4, wherein the first aperture is positioned at an end of the first portion and the second aperture is positioned at an end of the second portion such that the first and second apertures are positioned at opposite ends of the elongated hollow structure.

7. The apparatus for removing debris of claim 1, the rod is constructed of one plastic, steel, steel, aluminum and fiberglass.

8. The apparatus for removing debris of claim 1, wherein the ram link is constructed of one of rubber, vinyl, polyurethane, spring metal and flexible conduit.

9. The apparatus for removing debris of claim 1, wherein the rod is positioned to extend out of the first aperture and the ram moves out of the second aperture as the rod is moved into the elongated hollow structure through the first aperture.

10. The apparatus for removing debris of claim 1, wherein at least a portion of the ram link is constructed of one of a hollow conduit and solid structure.

11. An apparatus for removing debris, comprising:

an elongated hollow structure wherein:

at least a portion of the elongated hollow structure extends in a curved configuration; and the elongated hollow structure comprises a sidewall which defines an opening which extends within and along the elongated structure and defines a first and second apertures spaced apart from one another and in communication with the opening; and an elongated insert member having a length which exceeds a length of the elongated hollow structure and has a width dimension smaller than a width dimension of the opening and the first and second apertures such that the elongated insert member slides within the elongated hollow structure and in and out of the first and second apertures, wherein the elongated insert member comprises:

a rod; and a ram component comprising a ram link and a ram, wherein:

the ram link extends from an end of the rod and the ram link comprises a flexible conduit;

the ram extends from the end of the ram link and comprises one of a spring structure or flexible conduit; and each of the ram link and the ram are more flexible than the rod.

12. The apparatus for removing debris of claim 11, further includes the spring structure is constructed of metal.

13. The apparatus for removing debris of claim 11, wherein a width dimension of the ram link is less than a width dimension of the rod and a width dimension of the ram is less than the width dimension of the ram link.

* * * * *